US011608639B1

(12) United States Patent
Van de Steeg

(10) Patent No.: US 11,608,639 B1
(45) Date of Patent: Mar. 21, 2023

(54) ANTI-HAIL ROOFING SYSTEM

(71) Applicant: Leigh B Van de Steeg, Luther, OK (US)

(72) Inventor: Leigh B Van de Steeg, Luther, OK (US)

( * ) Notice: Subject to any disclaimer, the term of this patent is extended or adjusted under 35 U.S.C. 154(b) by 0 days.

(21) Appl. No.: 17/892,236

(22) Filed: Aug. 22, 2022

(51) Int. Cl.
*E04D 3/30* (2006.01)
*E04H 9/16* (2006.01)

(52) U.S. Cl.
CPC ..... *E04D 3/30* (2013.01); *E04H 9/16* (2013.01)

(58) Field of Classification Search
CPC ..... E04H 9/16; E04D 2001/308; E04D 1/30; E04D 13/076; E04D 2013/0463; E04D 3/30
See application file for complete search history.

(56) References Cited

U.S. PATENT DOCUMENTS 5,343,664 A * 9/1994 Loucks ..... E04D 13/076 52/518
5,440,855 A * 8/1995 Loucks ..... E04D 1/29 52/518
5,526,626 A * 6/1996 Loucks ..... E04D 13/076 52/750
6,609,337 B1 * 8/2003 O'Connell ..... E04D 1/2963 52/541

FOREIGN PATENT DOCUMENTS

DE 2855743 12/1978

OTHER PUBLICATIONS

Erie; "Trust Our Expert Metal Roofing Contractors"; retrieved on Jul. 21, 2022 from https://eriemetalroofs.com.
Euroshield; "Best Roof for Hail"; retrieved on Mar. 31, 2022 from https://www.euroshieldroofing.com.

* cited by examiner

*Primary Examiner* — Andrew J Triggs
(74) *Attorney, Agent, or Firm* — Robert H. Frantz

(57) ABSTRACT

A section of a roof covering system, such as a shingle, having a flat base with planar top surface; and a plurality of fins disposed on the planar top surface at an essentially orthogonal angle to the planar top surfaces, forming a plurality of valleys between the fins, thereby forming a plurality of protrusions and recesses to damage, disintegrate and redirect hailstones which are incident upon the portion of the roof covering system.

10 Claims, 8 Drawing Sheets

200

300

ANTI-HAIL ROOFING SYSTEM

FIELD OF THE INVENTION

This invention relates to roofing systems for homes and commercial structures.

BACKGROUND OF INVENTION

Throughout the history of constructing homes and business buildings, hail has been a major source of damage to roofs, costing untold amounts in money and labor for the owners of the structures and the insurance companies which cover them. Many "hail resistant" roofing products have been brought to market, but the problem persists, so insurance rates remain high, destruction of difficult-to-recycle materials remains high, and the demand for labor to perform installations and repairs at dangerous heights remains high.

SUMMARY OF THE EXEMPLARY EMBODIMENTS OF THE INVENTION

Disclosed is an invention which includes a section of a roof covering system, such as a shingle, having a flat base with planar top surface; and a plurality of fins disposed on the planar top surface at an essentially orthogonal angle to the planar top surfaces, forming a plurality of valleys between the fins, thereby forming a plurality of protrusions and recesses to damage, disintegrate and redirect hailstones which are incident upon the portion of the roof covering system.

BRIEF DESCRIPTION OF THE DRAWINGS

The figures presented herein, when considered in light of this description, form a complete disclosure of one or more embodiments of the invention, wherein like reference numbers in the FIGS. represent similar or same elements or steps.

DETAILED DESCRIPTION OF ONE OR MORE EXEMPLARY EMBODIMENTS OF THE INVENTION

Figure 1:
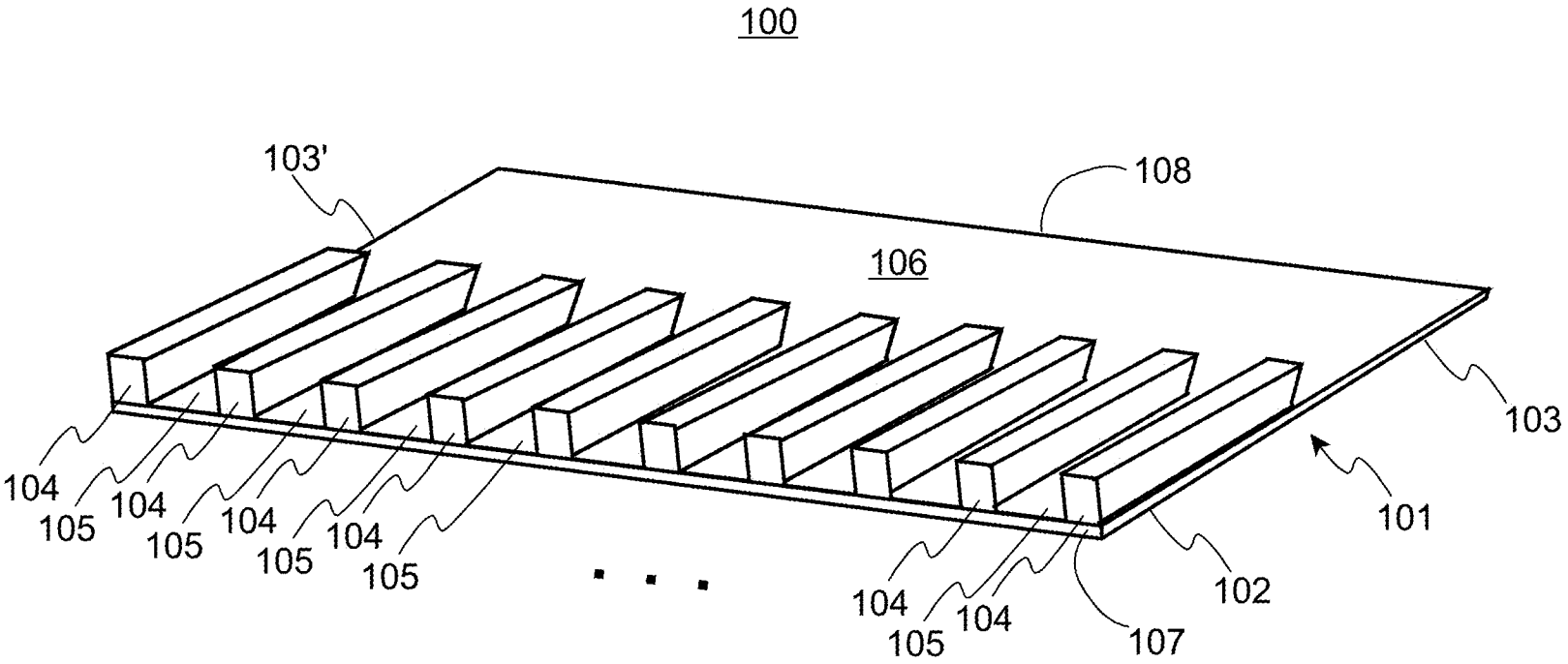
FIG. 1 depicts a perspective view of a first example embodiment according to the present invention of a single roofing system "shingle".

The present inventor has recognized that existing roofing systems, components and materials remain susceptible to hail damage even though they are designed and advertised to be hail resistant. The present inventor has departed from the conventional design of using materials which are impact resistant to employ a novel approach of making the shingles themselves destructive to hail stones which strike them, through a combination of features to break apart hail stones and to redirect their remaining energy through deflection. Additionally, some embodiments of the present invention provide for novel interlocking features that improve resistance to wind lift of the shingles in the system.

The function and benefit of the embodiments of the present invention are to produce a stronger and more durable shingle that offers a higher impact protection to the shingle primarily from hailstones, with optional design features which provide higher protection from high wind uplift and high wind damages. Increased hail impact durability is provided by raised ridges and fins that rise above the shingle base, while the shingle base offers the conventional water shedding attributes similar to most other roofing products that protect the space below from water intrusion.

When a falling hailstone comes into contact with the ridge or fin elements, the impact mechanics allow for a higher percentage of hailstones, with a higher kinetic energy value, and/or a higher compressive stress value, to disintegrate when the momentum transfer has occurred. The remaining kinetic energy held by the falling or wind driven hailstone gets focused at a smaller point of contact with the ridge or fin. The energy from the hailstone impact received at the contact point of the ridge or fin is dispersed along the ridge or fin outwardly at a decreasing value, and also transferred downward into the shingle base under the ridge or fin, resulting in a larger and more dispersed impact energy area than conventional designs that do not offer a separate impact point above the shingles base.

This shingle advanced and improved function allows for a higher hail impact resistance, without damage to the roof covering or shingle when compared other roofing finish products that do not incorporate these ridge or fin elements.

At a certain point when impact occurs with consideration to the hailstones integrity value to keep its form, shape and size, and when the kinetic energy value that is transferred into the hailstone at the impact point, the hail stone will tend to disintegrate partially, or fully fail to keep its original form, shape and size.

The raised ridges or fins deliver higher compressive stress forces to the hailstone, than roof coverings that do not incorporate this design. This will occur more often when the hailstone impacts the roof covering at a perpendicular or 90 degree angle.

At least one benefit of embodiments according to the present invention is that this new shingle design is prone to make the hailstone disintegrate earlier and easier when it impacts the ridge or fin at a more focused point(s) of impact. Smaller and larger hailstones will fail or disintegrate without permanently damaging the shingle, and will offer a design that contributes to less wear and tear for a longer usable life span of the product.

Once the hailstone impacts any roof covering and fails to keep its original form, shape and size, it partially or fully disintegrates into smaller pieces. Those smaller pieces then travel at a reduced speed, and thus hold far less individual mass and kinetic energy damage potential. Once this occurs, what is left of the once solid hailstone no longer carries much damage potential to the undamaged roof coverings. This disintegration occurs more often when the hailstone is traveling perpendicular, or close to perpendicular to the roofing surface and maximum compression force occurs.

The hailstones disintegration or changes in trajectory after impact will continue to occur until the kinetic energy and the integrity of the hailstone exceeds the integrity value of the shingles causing a split, separation, opening, tearing, fracturing or rupturing. When this occurs and the shingle fails to shed 100% of the water, or there is reason to believe there will be a diminution of water shedding capabilities, the damage may allow moisture to pass through the shingle base. One of the benefits of this shingle design will disintegrate larger hailstones with higher damage potential than roofing products without the ridge or fin feature.

At some point if there is not a sufficient impact or reduction of energy absorbed by the falling hailstone from a sudden decrease in speed and trajectory as a result of momentum transfer from a roof covering impact, the hailstone may ricochet, bounce, or glance off the roof covering without disintegrating. This results in the diverted hailstone retaining less damage potential to the undamaged roof coverings.

The raised ridges or fins design may provide additional damage protection during the initial impact or momentum transfer from the incoming hailstone, when the raised ridge/fin diverts the hailstone at a higher degree of angle when compared to more conventional roof covering that do not offer this raised ridge/fin design element. Depending on the angle at which the hailstone impacts, and its strength/integrity characteristics, a portion or percentage of the hailstone may enter the valley area before impact occurs at the ridge/fin. When this occurs, the impact point is at a different angle to the hailstone's center of mass that it would be if that same hailstone impact was to a flat surface. The impact mechanics of this will allow for a bigger transfer of momentum, and additional kinetic energy to be transferred to the shingle. After the impact, the hailstone will now carry less damage potential, and the trajectory will be altered at an increased deflection angle. This would occur more often when the hailstone is being driven by wind and impacts the raised ridge/fin in a more side impact manner, as opposed to a parallel impact along the ridge/fin axis. This momentum transfer will deliver a higher level of kinetic energy into this shingle design, because the impact point will be at a different spherical angle than the traditional glancing impact of the hailstone.

As the hailstones get larger with more mass and more kinetic energy, and when hailstones contain a high level of structural integrity, the hailstones damage potential increases. All finished roof coverings have damage thresholds. In particular a hail damage threshold indicates the smallest size of hail which might cause functional hail damage to a particular type of roof covering. Based on many atmospheric conditions, the hailstone's characteristics including but not limited to, volume, free-fall velocity, size, mass, density, temperature, state of physical bonds, elemental or chemical makeup, and direction or angle of impact, an exact hail damage threshold cannot be determined, but can be approximated.

Considering all the variables and impact mechanics, additional testing results will be useful in determining how a specific embodiment performs in a real-world setting for specific geographic areas and the hailstones which occur ordinarily in those areas. A general average or range of hail damage thresholds can be determined and utilized, as long as the test are performed in a consistent and congruous trial setting.

Falling or wind driven hailstones do not need to necessarily impact ridge/fin at a 90 degree or perpendicular angle in order to disintegrate the hailstone partially or fully. The hailstones may make initial contact at a slight, moderate or high degree of angle, and this ridged or finned shingle will continue to offer a greater impact resistance than roof coverings that do not offer this ridge/fin design.

Some embodiments according to the present invention may allow the ridge or fin to run straight, plumb, vertically from the top of the roof down to the roofs edge or eve. Other embodiments may allow the ridges or fins to run consistently at an angle, or change directions to allow for designs that may be aesthetically pleasing to the end user. Still other embodiments may allow for every other, third, fourth, fifth etc. ridge or fin to be taller, shorter, thicker/wider, than others within the roof covering. The ridge or fin elements may also have two or more different heights, thickness and widths.

Yet other embodiments may have the ridge or fin elements changing course every 1", 2", 3", etc. using a hard angle change, or smother radius angle change, to protect against hailstone impacts which occur at a high degree of angle instead of the unmanipulated vertically free-falling hailstones. Most embodiments will remain consistent with a continuation or congruity within the ridge/fin pattern, but may not necessarily have a common replication of ridge or fin dimensions. One example is a roof area may have some protection from a large tree canopy, or upper level patio deck, or a larger structure such as a separate building, that may protect one side or area of the roof. The reason may be some roof areas may not require the added expense involved utilizing a larger or taller ridge/fin pattern that may have higher manufacturing cost.

Another embodiment may have one or more layers of reinforcing materials held within the shingle body, much like rebar in some concrete applications.

Another feature or benefit from of the embodiments of the present invention is the angled overlap at the termination of the ridge/fin. This feature allows for a next course of roofing material to withstand higher wind uplift protection. If there are sufficient wind speeds to create uplift at the lowest exposed edge of the shingle, where this typically occurs, the overlapping ridge/fin from the downslope shingle that extends over the start or beginning of the upslope shingle, will stop and hold the upslope shingles base's starting edge from rising sufficiently to cause or allow any damage to the upslope's shingle. This overlapping ridge/fin design greatly increases the threshold for high wind uplift before any wind damage can occur to the roof covering. For this design to fail, either the many ridge/fin overlap points will need to be sheared off by the shingle base that is being held by those points, or where the shingle base contacts the overlapping points will need to rip or tear in a way that will allow the base to get passed, or raise above the overlapping points that were holding that edge down.

The extreme high wind uplift protection may also be bolstered by where the shingle fastener placement occurs with relation to the downslope shingle. The faster placement of the downslope shingle is in the traditional area around 1"-3"above the ridge/fin overlap that is covered by the upslope's shingles lower exposure area. If there are sufficient high winds to create shingle uplift but not enough to damage the above-mentioned ridge/fin or shingle base, the overlapping ridge/fin area will require force to pull or extract out the shingle fasteners from the roof deck before wind damage can occur to the shingles.

Referring now to FIG. 1, a perspective view of a generalized embodiment according to the present invention is shown in which a plurality of fins or ridges 104 are provided protruding above a shingle base, separated by a plurality of valleys 105. As will be discussed in the following paragraphs, the shapes of the top edges of the fins, their heights (valley depths), and the spacings between the ridges 104 are all determined and proportionally related in a manner which is destructive to hailstones which are incident upon the improved shingle 100, which cause deflection and redirection of impact energy of the hailstones, or both.

FIG. 1 also provides for reference purposes, but not intended to be limiting in embodiment realizations, an upper edge 108 of the example improved shingle 100 which would, when installed, be above a lower edge 107, wherein a bottom surface 101 is provided to contact the roof deck or roof underlayment, and an upper surface provides a zone 106 for nailing and for overlapping by the next shingle above the current shingle. A first side edge 103 and a second side edge 103' to the shingle base.

Figure 8:
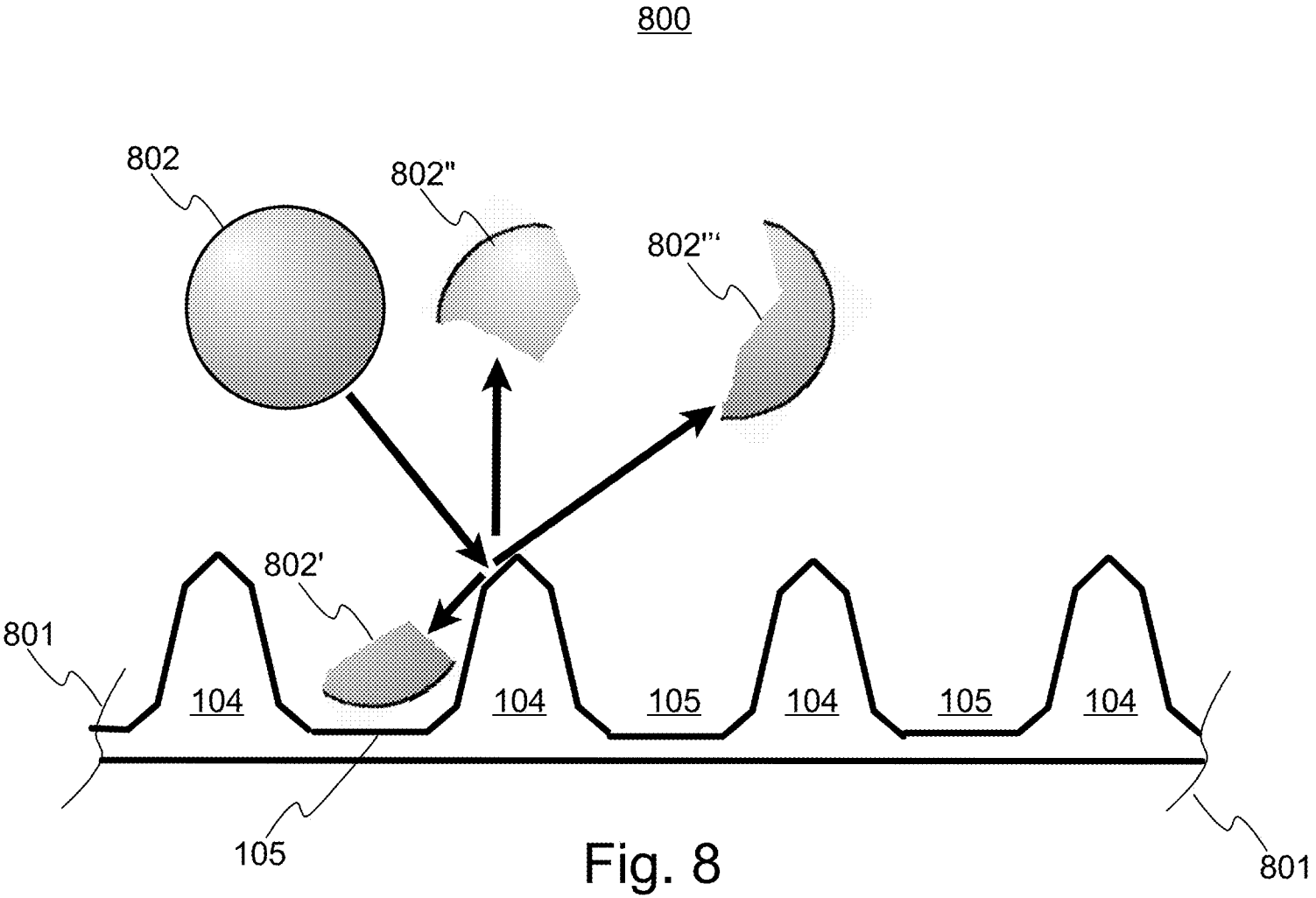
FIG. 8 illustrates the hailstone destroying and energy redirecting functions of the embodiments according to the present invention.

Referring now to FIG. 8, an end view 800 of a portion 801 of an example embodiment of an improved shingle according to the present invention is shown, in which the top surfaces of the ridges 104 are provided with one or more edges which are destructive and/or redirective to a hailstone 802 which strikes the shingle. Some portions 802' of the hailstone may be deflected into one or more valleys 105, and some other portions 802" and 802" may be deflected upwards and away from the shingle. The shingle ridge may be made of a material which is rigid, such as metal, or may be made of, at least in part, a material which is less than rigid such that it absorbs a portion of the energy of the hailstone but also provides enough focused impact to the hailstone to crack or fracture it. This is the general operation of the improved shingles of the various embodiments which will be discussed in the following paragraphs.

Figure 2:
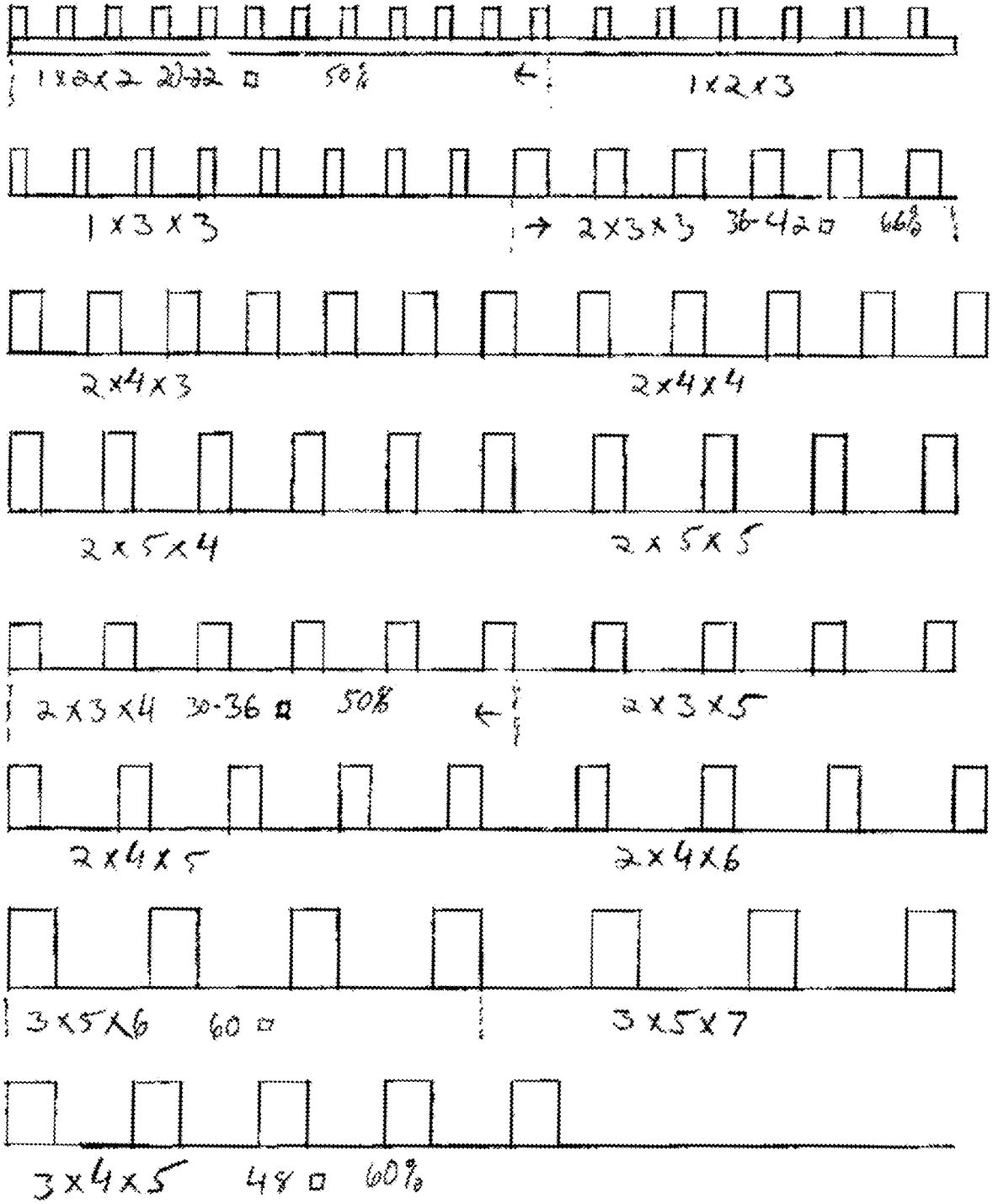
FIG. 2 illustrates cross-sectional profiles of a number of embodiments according to the present invention with various ratios of widths of ridges, depths of valleys (a.k.a. heights of ridges) and widths of valleys.

Referring now to FIG. 2, a plurality of end views 200 of various embodiments of improved shingles according to the present invention are shown, all of which are shown with flat tops to the ridges or fins. The fins or ridges may have other effective shapes or edges formed on the tops of them, as will be discussed in more detail in the following paragraphs. In this illustration, one can see various ratios of fin width to fin height to distance between fins which are known or expected to provide the destructive and/or redirective function for hailstones as previously discussed with respect to FIG. 8. Because various geographical areas experience larger and smaller hailstones with greater and lesser velocities, different ratios of the fin and valley geometries may be appropriate in different geographical areas.

Figure 3:
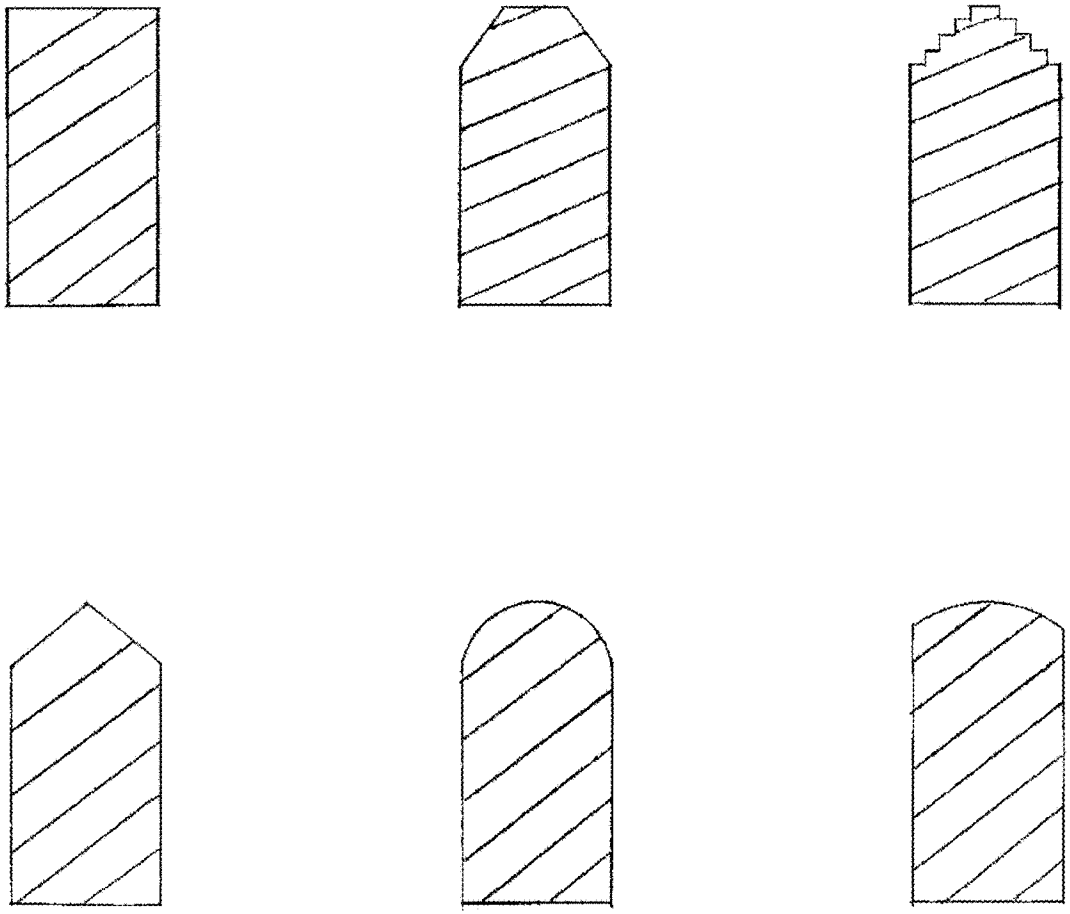
FIG. 3 shows cross sectional views of a number of embodiments according to the present invention with various hail-destructive shapes formed or provided on the top edges of ridges.
Figure 4:
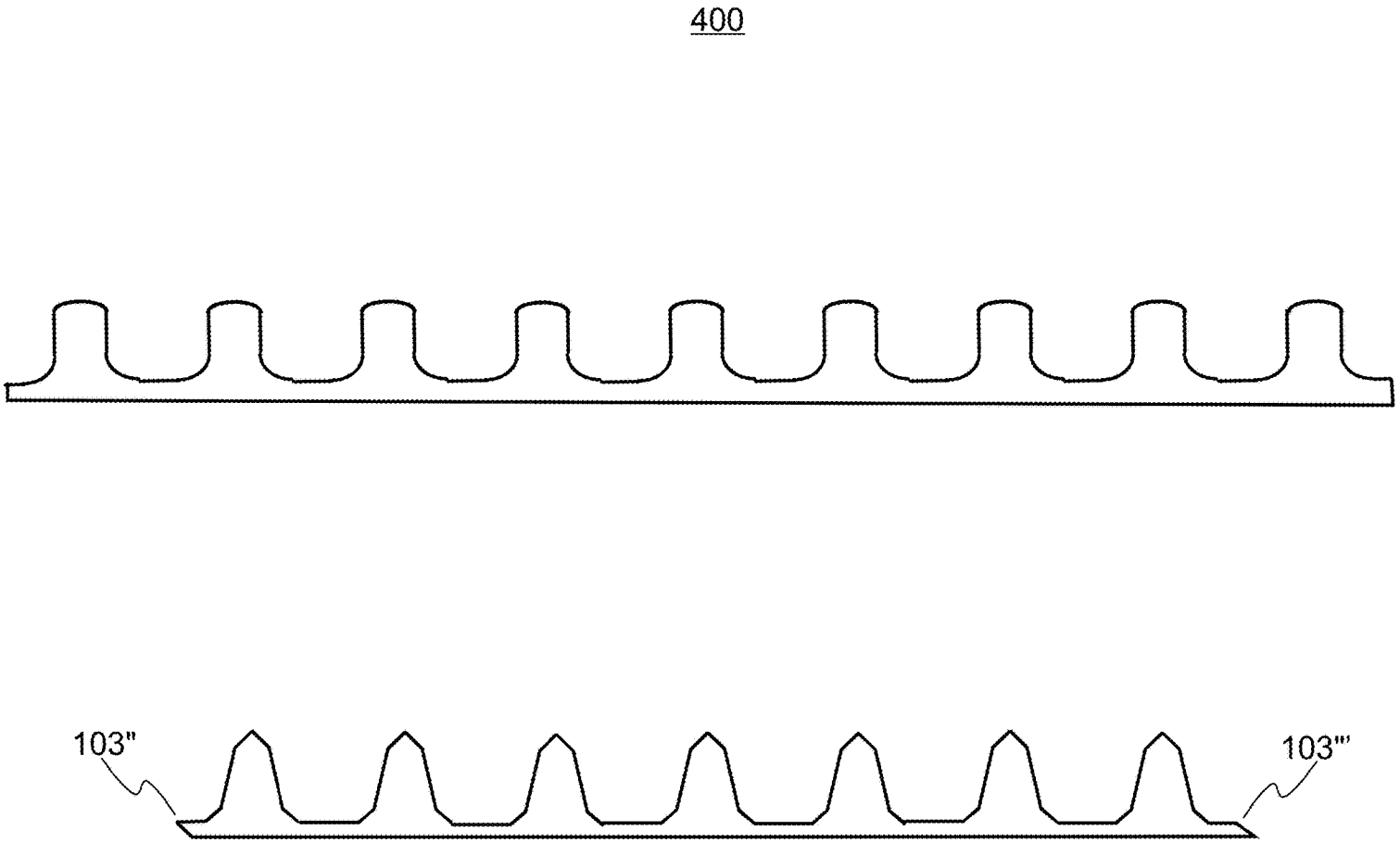
FIG. 4 depicts end-views of shingles with additional embodiments according to the present invention of ridge top shapes, ridge vertical edge shapes, and valley surface shapes, including an additional embodiment of an edge of the shingle to limit the effects of thermal expansion.

Turning to FIG. 3, a plurality of cross sectional end views 300 of various embodiments of fins or ridges 104 according to the present invention are shown to illustrate ridge top edges or surface shapes which are known or expected to provide the destructive and/or redirective function for hailstones as previously discussed with respect to FIG. 8. FIG. 4 extends the illustration of at least two ridge designs to illustrate the lateral pattern of fins (or ridges) and valleys. Please note in FIG. 4 that an additional improvement is shown to the side edges 103" and 103'" which limits possible negative effects due to thermal expansion of the shingles.

Figure 5:
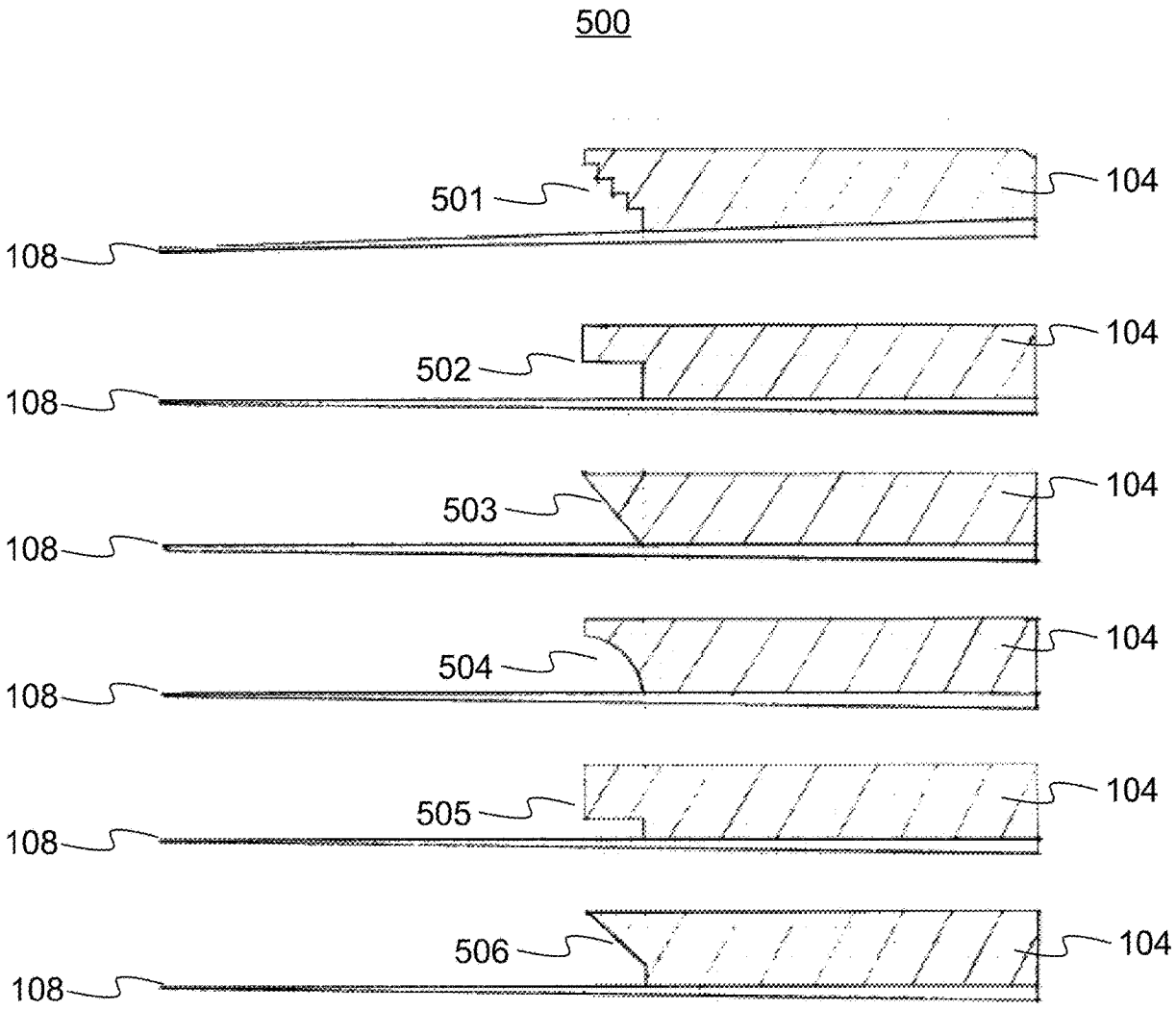
FIG. 5 illustrates a side view of a number of embodiments of fins or ridges according to the present invention with various upper edge shapes to provide for interlocking with the lower edges of the row of shingles above the current row of shingles to resist wind lift.

FIG. 5 illustrates 500 a plurality of side views taken from a right side edge of example embodiments according to the present invention to show more details of a number of upper ends 501-506 of fins or ridges. These modified and improved upper ends of the ridges allow a bottom edge of the next-above shingle to nest into the ridges of the current shingle to help hold the next-above shingle down during wind lift.

Figure 6:
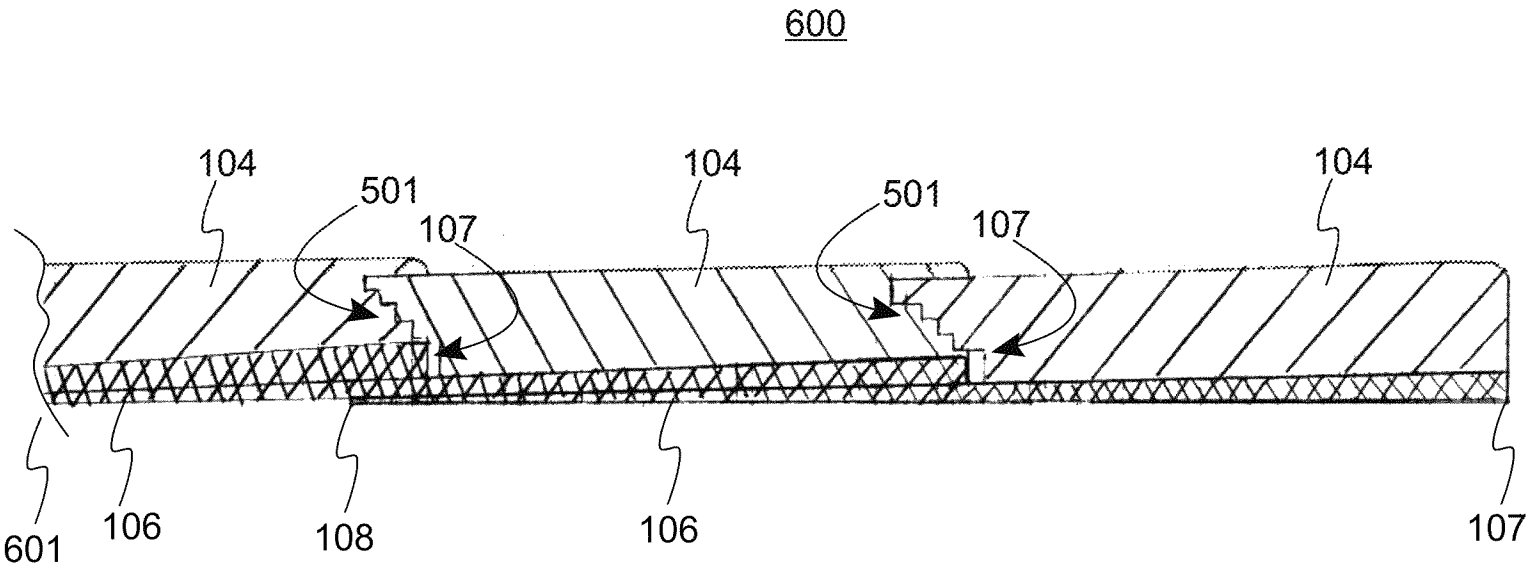
FIG. 6 shows a side view of the interlocking feature of at least one example embodiment from FIG. 5.

FIG. 6 shows 600, from an edge view perspective, how two rows and a portion 601 of a third row of shingles interlock the lower shingle edges 107 of the next-above shingle into the top edges 501 of the fins of the next-below shingles. In this diagram, the cross-hatched portions are the bases of the shingles, and the diagonally-hatched portions are the fins or ridges. Also, this illustration shows how at least one embodiment of the present invention provides a tapered shingle base which is thinner (less thick) towards the upper edge 108 of the shingle and thicker towards the lower edge 107 of the shingle.

Figure 7:
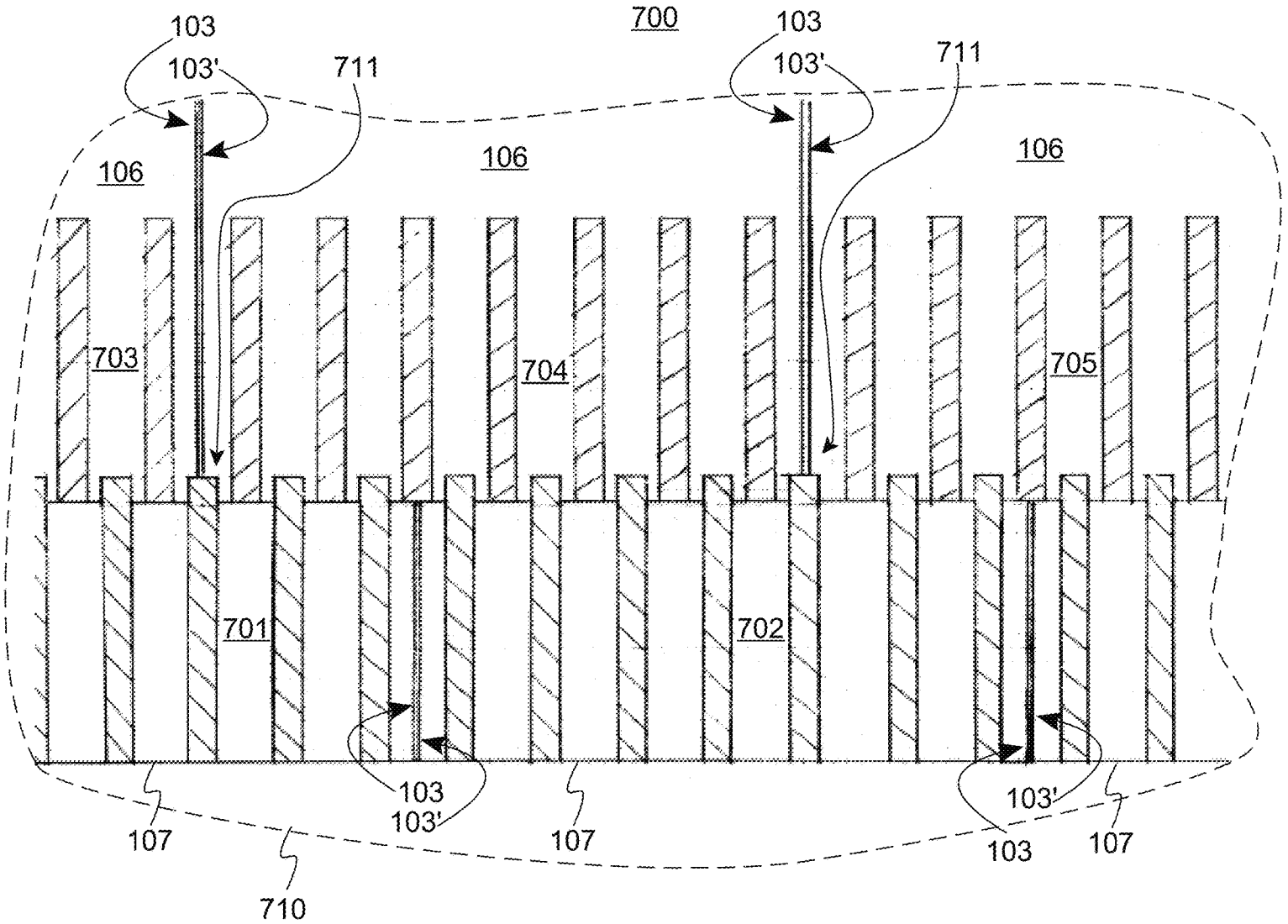
FIG. 7 provides a top-down view of a few shingles according to the present invention installed to provide a roofing system.

Referring now to FIG. 7, a top-down view 700 of a portion 710 of an installed roofing system incorporating the improved shingles according to the present invention is shown. In this configuration, a first row 701 and 702 of improved shingles is installed with its lower shingle edges 107 towards the downward slope of the angled roof deck (and underlayment in some installations). The nail zones are hidden from this view as they are covered by the ridge and valley areas of the next-above row of shingles 703, 704 and 705, with the lower edges of the second-row shingles optionally received into the upper edges of the ridges of the first row 701 and 702, as previously discussed with respect to FIGS. 5 and 6.

Please note also that, if the spacing of the ridges and the shifting of seams 103 and 103' from row to row permits in some configurations, the upper edges of the ridges or fins for the lower row can be instrumental in holding down 711 the lower edge corners of the next-above row of shingles, as shown 700.

Regarding methods of manufacture of the embodiments of the present invention, many of the conventional materials and processes may be reconfigured to produce the shingles in a single component or a plurality of components, such as but not limited to stamping, extruding, molding, assembling, affixing, and shaping metals, petroleum-based materials (e.g., asphalt, tar, etc.), plastics, ceramics, rubbers, wood and natural fibers, in combination or isolation of each other.

The terminology used herein is for the purpose of describing particular exemplary embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof, unless specifically stated otherwise.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

Certain embodiments utilizing a microprocessor executing a logical process may also be realized through customized electronic circuitry performing the same logical process(es). The foregoing example embodiments do not define the extent or scope of the present invention, but instead are provided as illustrations of how to make and use at least one embodiment of the invention.

What is claimed is:

1. A section of a roof covering system comprising:

a base portion having a substantially planar top surface; and a plurality of fins disposed on the planar top surface at an essentially orthogonal angle to the planar top surfaces, the fins having a first height, wherein each fin has a rigid-material top shape configured to destruct, or redirect, or both destruct and redirect hailstones;

wherein the plurality of fins form a plurality of valleys therebetween, the valleys having a first width, thereby forming a plurality of protrusions and recesses configured to damage, disintegrate and redirect hailstones which are incident upon the portion of the roof covering system.

2. The section of a roof covering system as set forth in claim 1 wherein the base portion is provided with a nail zone free of the plurality of fins.

3. The section of a roof covering system as set forth in claim 2 wherein each of the plurality of fins comprises an upper edge shape adjacent to the nail zone, and wherein the fin upper edges are formed to capture a lower edge of a next-course section of roof covering to prevent wind lift.

4. The section of a roof covering system as set forth in claim 1 wherein the first height of the fins corresponds to a pre-determined maximum hailstone size.

5. The section of a roof covering system as set forth in claim 4 wherein the pre-determined maximum hailstone size is determined according to a geographical historical hailstone range.

6. The section of a roof covering system as set forth in claim 1 wherein the first width between the fins corresponds to a pre-determined maximum hailstone size.

7. The section of a roof covering system as set forth in claim 6 wherein the pre-determined maximum hailstone size is determined according to a geographical historical hailstone range.

8. The section of a roof covering system as set forth in claim 1 wherein the plurality of fins comprise two or more different heights.

9. The section of a roof covering system as set forth in claim 1 the plurality of fins.

10. The section of a roof covering system as set forth in claim 1 wherein the plurality of fins comprise a top edge of each fin, and where each top edge is provided with a contour for enhancing destruction and/or redirecting of incident hailstones.

* * * * *